United States Patent [19]

Bechtel

[11] 4,367,606

[45] Jan. 11, 1983

[54] MOUNT FOR RIFLE TELESCOPE SIGHT

[76] Inventor: Daniel L. Bechtel, P.O. Box 11281, Fort Worth, Tex. 76109

[21] Appl. No.: 178,782

[22] Filed: Oct. 6, 1980

[51] Int. Cl.[3] ..... F41G 1/38

[52] U.S. Cl. ..... 42/1 ST; 33/250

[58] Field of Search ..... 42/1 ST; 33/250

[56] References Cited

U.S. PATENT DOCUMENTS

| | | | |
|---|---|---|---|
| 2,449,551 | 9/1948 | Garand | 42/1 ST |
| 3,483,623 | 12/1969 | Kruzell | 42/1 ST |
| 4,044,486 | 8/1977 | Van Holten | 42/1 ST |

*Primary Examiner*—Charles T. Jordan

*Attorney, Agent, or Firm*—Charles W. McHugh

[57] ABSTRACT

An apparatus for mounting a scope on a rifle without the necessity of drilling or tapping any holes in the rifle receiver. A small removable plate has a configuration which permits it to be inserted into a prepared recess along the side of the rifle. The plate has front and rear edges which are appropriately shaped and sized so as to be inserted into confronting grooves which coincide generally with the front and rear boundaries of the prepared recess. The plate is configured so as to abut a rigid portion of the rifle (e.g., a top portion of the receiver) in order that there will be a limitation on its upward movement. The plate has threads which are accessible from the outer surface of the plate; preferably, these threads are female threads in a central bore which extends through the plate. A base for holding a scope is selectively mountable on the plate, so that the scope will be essentially parallel to the bore of the rifle. The base may be removed from the plate at will, by disengaging a single threaded member. The base (and any attached scope) is directly connected to the removable plate and only indirectly connected to the rifle. The base may also be tilted with respect to the rifle in order to foster proper elevation at the scope.

15 Claims, 7 Drawing Figures

MOUNT FOR RIFLE TELESCOPE SIGHT

This invention relates generally to techniques for mounting a scope on a rifle; more particularly, it relates to a method and apparatus for mounting a scope without the necessity of drilling and tapping holes in the receiver of a rifle.

There has long been a practice of mounting a scope generally parallel to the bore of a rifle in order to foster the accurate "sighting" of the rifle in anticipation of firing a bullet. Exemplary of techniques for mounting rifle scopes are the devices shown in the following U.S. Pat. Nos.: 2,187,054 to Redfield; 2,445,595 to Bengert; 2,743,526 to Ivy; 2,854,748 to Williams; 3,414,221 to Nelson; and 3,463,430 to Rubin, et al. One of the characteristics of such scope-mounting devices is that they are attached to the rifle by virtue of providing threaded holes into which mounting screws can be inserted. Sometimes the holes are drilled and tapped at a factory during the process of manufacturing the rifle; at other times, holes are drilled by a gunsmith or other skilled person and subsequently tapped to provide the necessary threaded holes.

The technique of drilling and tapping holes into the receiver of a rifle involves at least two potential problems. First, there is the difficulty involved in accurately drilling a hole of a desired size and achieving precision threads in that hole—with the restriction that there is essentially no room for error. And, the owner of a valuable rifle is not inclined to turn it over to just any person for the purpose of drilling holes into the rifle's receiver. A poor job of attempting to mount a scope can render a rifle dangerous or even useless, if the hole is drilled so that it weakens the receiver and/or allows the escape of gases which are intended to propel a bullet forwardly or push a bolt rearwardly, etc.

A further problem with the well-known technique of drilling and tapping holes has been brought about by the recent trend to heat-treat rifle receivers so that their hardness becomes a major obstacle to any kind of drilling and tapping—no matter how skillful or well equipped a gunsmith is. The problem of breaking drill bits and/or taps when attempting to work on super-hard receivers has been made particularly apparent with rifles such as the Ruger MINI-14 rifle manufactured by Sturm, Ruger & Co. of Southport, Connecticut. A stainless steel receiver of a MINI-14 rifle typically has a hardness substantially in excess of 40 Rockwell C, and which is much harder than the receivers of many commercially available rifles. Accordingly, it is an object of this invention to provide a mounting technique which eliminates the need to drill and tap directly into a receiver in order to mount a scope on a rifle.

A further object is to provide a scope mount which may be easily mounted on and removed from a rifle with only a single mounting screw.

One more object is to provide a scope mount which offers substantial rigidity while using relatively few parts.

These and other objects will be apparent from a study of the specification and the claims appended thereto, as well as reference to the attached drawing in which FIG. 1 is a perspective view of a structural mount for holding a telescope on a rifle;

In brief, the invention involves use of a removable plate having a configuration which permits it to be inserted into a prepared recess along the side of the rifle. The plate has front and rear edges with thicknesses that are appropriately shaped and sized so as to fit snugly in grooves which coincide generally with the front and rear boundaries of the recess. A top portion of the plate abuts a rigid portion of the rifle, such that the plate has a limitation on its upward movement. The preferred embodiment of the plate has a central threaded bore which is accessible from the outer surface of the plate. A single screw with a large head engages the bore in the removable plate, so as to hold a scope base rigidly to the removable plate. Scope rings are attached to the rigid base for holding a rifle scope parallel to the rifle bore. When it is desired to remove the scope, the single screw is simply turned manually until it is disengaged from the plate; the plate may be left in the recess permanently, in order that the scope may be quickly reinstalled through engagement of a single screw.

Figure 1:
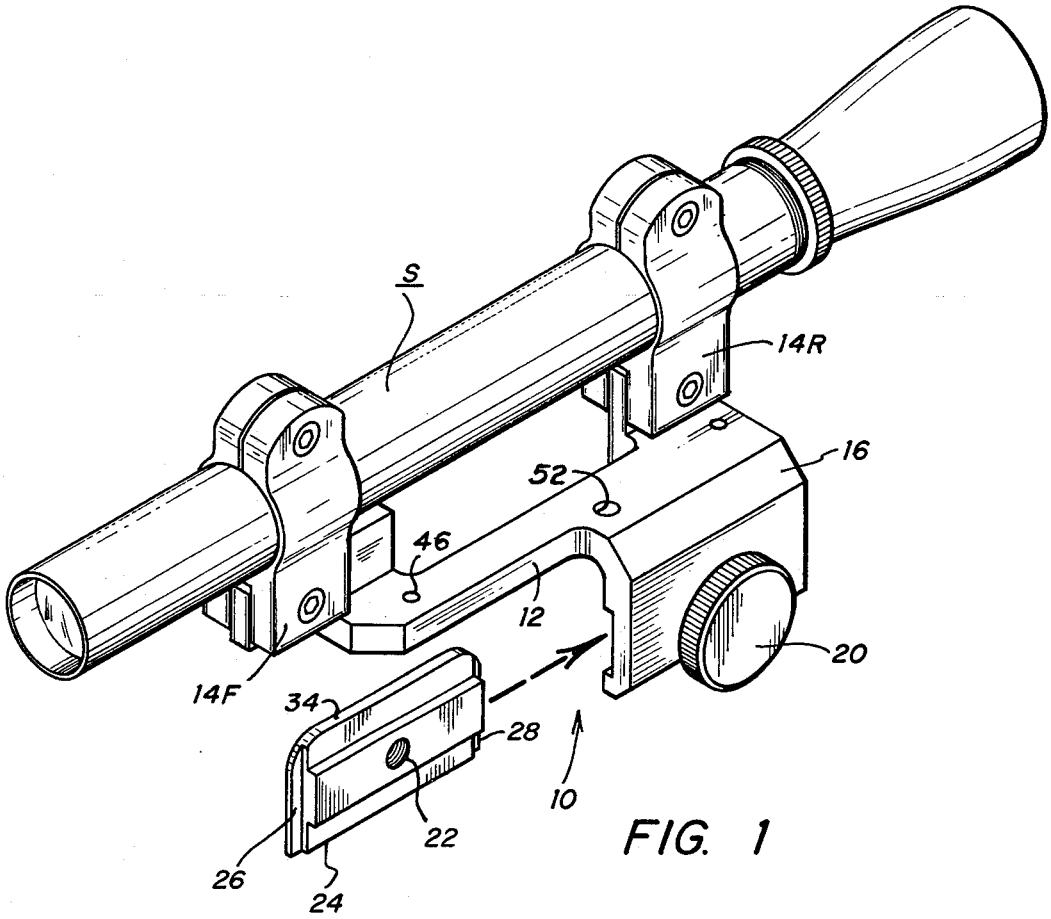

Referring initially to FIG. 1, a structural means is provided for holding a scope S so that it may be mounted on a rifle in a position that is essentially parallel to the bore of the rifle. Specifically, the structural device 10 includes a base or support means 12 for rigidly holding a scope through rings 14F and 14R. The base 12 has a depending portion which is adapted to lie alongside and rest against a portion of the rifle receiver. A bolt or screw 18 having a head 20 extends through the element 16 and protrudes inwardly (toward the receiver) for a sufficient distance so that the screw can engage the complementary threads of bore 22 in plate 24.

Figure 2:
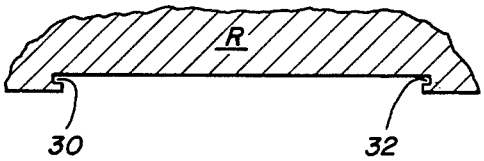
FIG. 2 is a fragmentary, top plan view of a side portion of a rifle receiver, showing a vertical recess into which a portion of the scope mount is fitted.

Referring additionally to FIG. 2, plate 24 is especially configured to fit within a prepared recess along the side of the rifle. The plate has a front edge 26 and a rear edge 28 which are appropriately shaped and sized so as to be inserted into grooves 30, 32 in the side of the receiver R. That is, front edge 26 is adapted to be inserted into front groove 30 at the same time that rear edge 28 is engaging rear groove 32. The top edge 34 of plate 24 has a configuration such that it will abut a rigid portion of the rifle's receiver R, in order to provide a limitation on the upward movement of the plate. In the embodiment shown in FIG. 1, the top edge of the plate is generally flat and perpendicular to the parallel edges 26, 28. However, if the edges 26, 28 are made so that they are inclined toward one another and would eventually intersect—if extended for a sufficient distance, then the upward movement of the plate 24 becomes automatically limited by the front and rear edges 26, 28 as they engage inclined grooves in the receiver outer wall.

Figure 3:
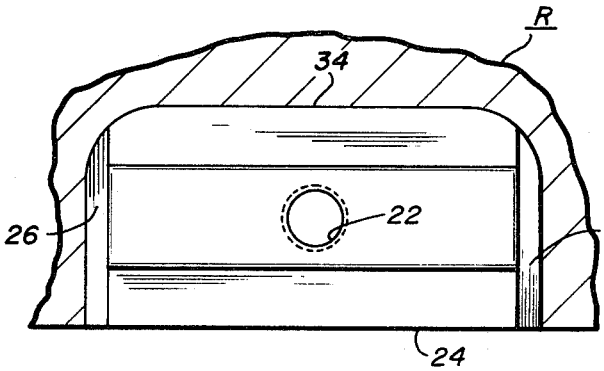
FIG. 3 is a front elevational view of a mounting plate which is configured to fit a recess in the receiver housing of a rifle.

Referring next to FIG. 3, a representative plate 24 for engaging a prepared recess on a Ruger MINI-14 rifle is shown. The plate 24 has parallel front and rear edges or lips 26, 28 separated by a longitudinal distance of about 1.5 inches. The thickness of the front and rear edges 26, 28 is about 0.062 inch, and the length of a given edge (in a direction parallel to the rifle bore) is preferably about 0.065 inch. The plate 24 has a central portion which is relatively thick, e.g., about 3/16 inch, in order to provide sufficient metal to create several full threads in bore 22. Preferably, the threads in bore 22 are sized for engaging a ¼-28 screw and holding the same rigidly. The bottom edge of the plate 24 is configured to rest immediately above the rifle stock, so that neither the stock nor the plate interfere with one another. In the embodiment shown in FIG. 3, the bottom edge is generally parallel to the top edge 34, and is located so as to be concealed by the bottom of depending element 16, thereby helping to guard against the entrance of any dirt or contaminants into the bottom portion of the prepared recess.

Figure 4:
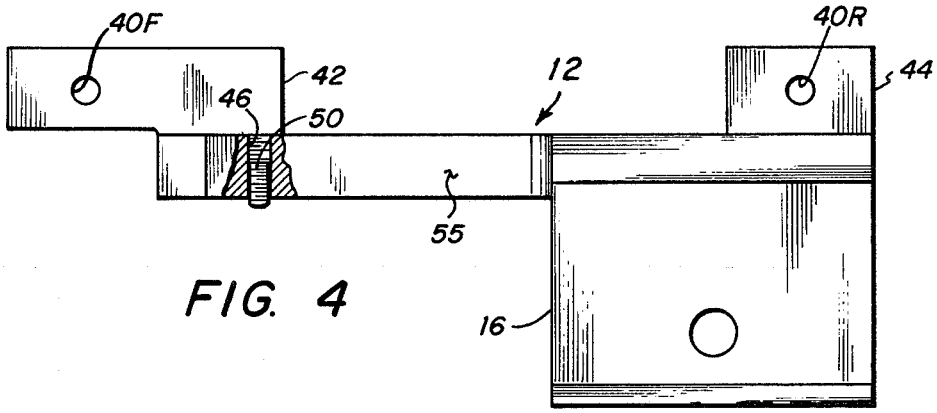
FIG. 4 is an "outside" elevational view of a base which may be easily attached to the plate shown in FIG. 3, using a single screw.

FIG. 4 illustrates an appropriate structural means for securely holding a scope on a particular rifle of recent vintage, namely, a Ruger MINI-14. Appropriate scope rings are mounted with suitable bolts which pass through the transverse bores 40F and 40R. One clear advantage of the construction shown in FIG. 4 is that two scope rings are employed, with a forward ring being mounted on a front post 42 that is well ahead of the receiver region. Such a construction is obviously going to offer more rigidity to a scope that a single ring mount, such as that shown in U.S. Pat. No. 2,445,595 to Bengert. Another advantage of the construction shown in FIG. 4 is that the rear post 44 is sufficiently forward of the rear of the receiver so that the eyepiece for a scope can be positioned at a safe and comfortable location for a shooter. The advantage of having the rear scope ring at a relatively forward location (instead of being too far to the rear) is that the shooter can "lean into" a customary shooting position without hitting his forehead on the scope eyepiece. If the rear scope ring was positioned significantly further back with respect to the receiver, the scope would have to be mounted too far to the rear; and a shooter would likely be forced to establish one relative position of his head with respect to the rifle when shooting with a scope, and establish a different relative position when shooting without the scope. The requirement for establishing two different firing stances would essentially preclude any proficiency that a shooter would otherwise achieve as a result of habits accomplished from regular practice.

Figure 5:
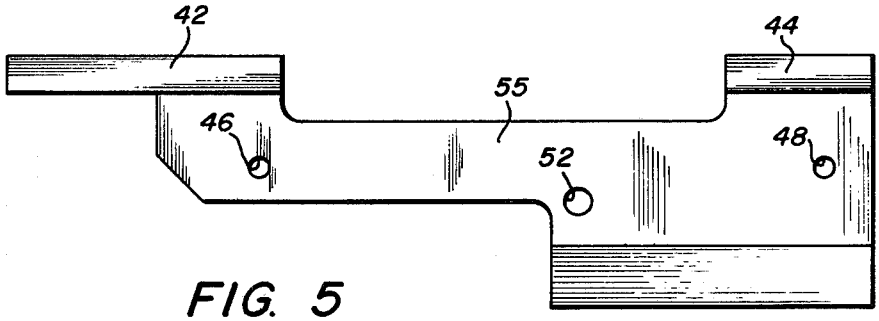
FIG. 5 is a top plan view of the mounting structure (or base) shown in FIG. 4.

FIG. 5 shows a top, plan view of the structure shown in FIG. 4. In this view are shown a pair of threaded apertures 46, 48 which extend vertically through the base 12 at locations respectively adjacent the forward and rearward ends of the base. Conventional set screws, one of which is shown in FIG. 4, are adapted to mate with threads in the vertical apertures 46, 48. Such set screws 50 are adapted to bear against the top of the rifle receiver in order to insure that there will not be any unwanted movement between the base 12 and the receiver. The set screws 50 should have a length of at least 3/16 inch, so that they are capable of providing at least some elevational adjustment for the scope; a preferred length is 5/16 inch. While a preferred embodiment includes two such apertures 46, 48, it should be apparent to a person skilled in the art that a single aperture and a single set screw could be utilized to help center and/or elevate a scope—if appropriate shims were utilized at opposite ends of the base. Also shown in FIG. 5 is a vertical bore 52 which provides access, directly or indirectly (through an auxiliary plunger), to the bolt lock plunger for late-model MINI-14 rifles. A functionally equivalent plunger is shown in FIG. 9 of U.S. Pat. No. 3,846,928 to Ruger and Sefried entitled "Bolt Latch for Auto-Loading Firearm". If the invention disclosed herein is to be utilized on a different rifle which has some other kind of bolt latch, then the aperture 52 might be omitted, or it might be altered in size or shape in order to insure access to a bolt or any other essential part of a rifle's operating mechanism.

Figure 6:
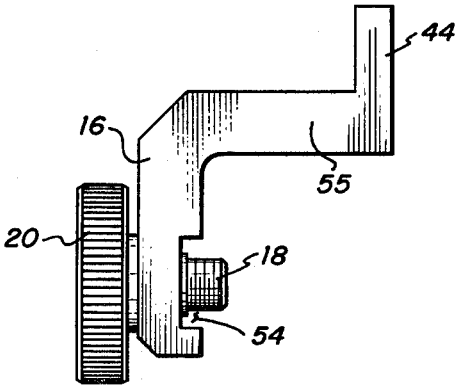
FIG. 6 is a rear elevational view of the structure shown in FIG. 4, with a mounting screw also being shown in this view.

In FIG. 6 there is shown a groove or recess 54 on the inside face of depending leg 16, which groove is sized to accomodate a retaining ring that engages the shank of screw 18 and prevents the accidental separation of said screw from member 16. In this way, the screw 18 will always be present on the structure 10 when it is needed. The horizontal recess 54 also provides clearance for the thickened portion of the plate 24 (i.e., the portion which has the female threads therein). The recess 54 is shown in this particular embodiment as extending for the full length of the depending leg 16, because the base 12 is designed to be manufactured from a special aluminum extrusion which eliminates the need to bore a shallow recess in the center of leg 16. Also shown in this figure is a ledge 55 which extends horizontally over and in close proximity to at least a portion of the rifle receiver. This structural ledge 55 precludes the base 12 and its attached plate 24 from moving downward with respect to the rifle—because of interference between the ledge and the rifle receiver. That is, once the plate 24 has been forced into its mating recess and the structure 10 has been attached thereto, the plate is locked against any accidental movement.

Use of the concept disclosed herein is naturally fostered by capitalizing on the existence of any prepared recess in a receiver housing—such as a recess that may have been placed on a rifle for some reason having nothing whatever to do with scope mounting. And, the Ruger MINI-14 rifle provides an excellent example of how to capitalize on such a situation. In that particular rifle, a suitable recess has already been provided in the left side of the receiver housing, and a thin piece of sheet metal is utilized by the manufacturer to cover that part of the receiver behind said recess. By temporarily separating the stock of a MINI-14 rifle from the receiver (by pulling the stock downward), the original cover plate can be removed and discarded, because it is far too flimsy to serve any purpose other than retaining a bolt latch or the like. When the original sheet metal plate has been removed, a recess in the receiver is available which has two spaced and generally facing grooves 30, 32 that extend in the same general direction on an exterior portion of the receiver housing. The next step in the process of mounting a scope consists of inserting a plate with a relatively thick portion within the space defined by the two spaced grooves 30, 32. The plate 24, of course, has a size so that it may be effectively wedged between the two facing grooves 30, 32 and also blocked against unrestrained vertical movement (in an upward direction). The receiver is typically made of heat-treated chrome-molybdenum or stainless steel, etc., so the exterior "lips" which extend outwardly over the grooves 30, 32 have more than enough strength to rigidly anchor a plate 24 to the rifle. The rifle stock may then be repositioned adjacent the receiver and barrel, and the rifle has been restored to its original effectiveness and operating condition. No original-equipment sights have been removed or altered, and no holes have been drilled in the receiver housing.

At any desired time, the support means for holding a scope can be attached to the side plate 24, by simply engaging the screw 18 in bore 22. When so connected, the scope mount will obviously be connected directly to the plate 24 and only indirectly to the rifle reciver. Later, if something should perhaps happen to damage the threads in bore 22, a simple "fix" involves removing a damaged plate 24 and discarding it, and then replacing it with a new plate having good threads. This simple and economical technique for eliminating damaged female threads on a rifle is obviously superior to the laborous task of repairing damaged threads within a receiver housing. And, at any selected time, the scope and its structural support may be easily removed from the rifle by simply turning knob 20 and its attached screw 18. It is for this reason that the knob 20 is preferably made rather large, and it is obviously designed to be rotated with fingers instead of being turned with a wrench.

The support means for a scope may be removed temporarily (or even permanently) without having any influence on the rifle's normal operation. The rectangular plate 24 has a sufficiently thin profile as to lie within the general spatial envelope defined by the original rifle, so there are no offending projections that extend outwardly beyond the width of the rifle's stock, and it is unlikely that a casual observer would even recognize that there had been any alteration in the rifle. And certainly there are no sharp corners or protuberances that would tend to catch on something when the scope is temporarily removed. Even with the scope support means removed, the plate 24 is in no danger of being lost, because the bottom edge of the plate fits flush against an upper portion of the rifle stock. As long as the stock is secured in its normal position adjacent the receiver, the plate 24 is held against any downward movement that would take it out of the recess. It is preferred that there be a distance of at least ½ inch in which the plate edges 26, 28 are engaged with grooves 30, 32, so an optimum plate is adequately captured within a rifle's recess and bounded on all four of its sides by appropriate structure.

Figure 7:
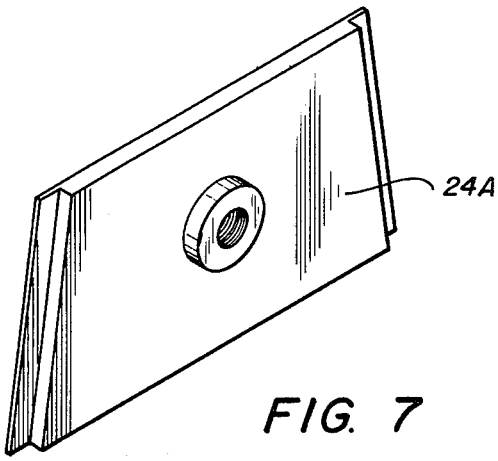
FIG. 7 is a perspective view of an alternate embodiment of the plate shown in FIG. 3, wherein the front and rear edges of the plate are co-planar and relatively inclined so as to provide a wedge-shaped base.

While the above discussion with respect to the MINI-14 rifle has described an opportunistic way of utilizing an existing recess on a particular rifle, this invention should not be considered as being limited to use on a specific rifle. And, when any manufacturer desires to take advantage of the benefits provided by this mounting technique, there is no reason why other rifles could not be manufactured with suitable grooves for accepting an appropriate mounting plate. Depending upon available space and the configuration of a rifle's receiver housing, the mounting plate may be shaped generally like plate 24 in FIG. 3 or plate 24A in FIG. 7, etc. Under certain conditions, it is even conceivable that the plate may be inserted into a recess that is oriented other than generally vertical (when the rifle is normally held horizontally). And, those skilled in the art will no doubt appreciate that other small variations can be made in the design disclosed herein. For example, the threaded member on plate 24 could be a stud having external threads instead of a bore having internal threads. In such an embodiment, the complementary member on the structural support would naturally have opposite threads, etc. Accordingly, it should be understood that the invention is to be considered as limited only by the terms of the claims which are appended hereto.

I claim:

1. Apparatus for mounting a scope on a rifle, comprising:

(a) a removable plate having a configuration which permits it to be inserted into a prepared recess along the side of the rifle, and said plate having front and rear edges which have thicknesses which are appropriately sized so as to be inserted into grooves which coincide generally with the front and rear boundaries of said prepared recess, and the plate being configured to abut a rigid portion of the rifle so that the plate has a limitation on its upward movement, and said plate having threads which are accessible from the outer surface of the plate; and (b) structural means for selectively mating with said plate and including a complementary threaded member for engaging the threads on said plate, and further including support means for holding a scope so that it is essentially parallel to the bore of the rifle.

2. The scope-mounting apparatus as claimed in claim 1 wherein the threads on the plate constitute threads in a bore, and the threaded member on the structural means constitutes a screw having an exposed head.

3. The scope-mounting apparatus as claimed in claim 1 wherein said means for holding a scope so that it is essentially parallel to the bore of the rifle includes a structural element which extends horizontally and in close proximity over at least a portion of the receiver of the rifle, whereby said structural element precludes an installed plate from moving downward with respect to the rifle because of interference between said structural element and the receiver of the rifle.

4. The scope-mounting apparatus as claimed in claim 3 and further including at least one threaded aperture which extends through the structural element at a location adjacent one end of said structural element, and further including a set screw which is sized to mate with threads in said at least one aperture, whereby said set screw may be positioned so as to bear against the rifle receiver in order to eliminate any unwanted movement between the structural element and the receiver.

5. The scope-mounting apparatus as claimed in claim 4 wherein there are two threaded apertures and two set screws, and each set screw has a length of at least 3/16 inch, whereby said set screws are capable of providing at least some elevation adjustment for the scope.

6. The scope-mounting apparatus as claimed in claim 1 wherein the thickness of said removable plate in the region surrounding said threaded bore is at least 3/16 inch, and there are at least five full threads in said threaded bore.

7. The scope-mounting apparatus as claimed in claim 1 wherein the threaded means on said plate constitutes a single threaded bore and the threaded element on said structural means constitutes a single screw, whereby a scope which is attached to said structural means may be selectively mounted on and removed from the rifle by appropriate turning of a single screw.

8. The scope-mounting apparatus as claimed in claim 1 wherein said plate constitutes a generally rectangular member with parallel front and rear edges, and the front and rear grooves in the rifle recess are generally parallel, and there is a distance of at least ½ inch in which the respective edges of the plate are engaged with the complementary grooves.

9. The scope-mounting apparatus as claimed in claim 1 wherein the recess on the rifle is generally to the left of and adjacent the rifle's receiver, and wherein said support means is configured for holding the scope generally above the receiver.

10. The scope-mounting apparatus as claimed in claim 1 wherein the plate has a sufficiently thin profile as to lie generally within the spatial envelope defined by the rifle, such that the plate may be mounted on the rifle for an indefinite period of time and the structural means may be temporarily separated therefrom without leaving any offending projections that extend beyond the rifle's spatial envelope.

11. The scope-mounting apparatus as claimed in claim 1 wherein the plate is configured on its bottom edge to fit flush against a portion of the rifle stock, and the plate is held against downward movement from the recess by the presence of the rifle stock.

12. The method of mounting a scope on a rifle without drilling holes in the receiver housing and without the necessity of tapping any existing holes in said housing, comprising the steps of:

(a) providing two spaced and generally facing grooves which extend in the same general direction on an exterior portion of the receiver housing;

(b) inserting a plate within the space defined by the two spaced grooves, and said plate having a size so that it may be effectively wedged between the facing grooves and also blocked against unrestrained vertical movement; and (c) selectively attaching a base for the scope mount to the plate at a desired time, whereby the scope is attached directly to th plate and only indirectly connected to the rifle receiver.

13. The method as claimed in claim 12 wherein the base for the scope mount is selectively attached to said plate using only a single screw, and including the further step of adjusting the inclination of the base with respect to the rifle bore by selectively elevating the ends of the base plate using at least one set screw which bears against the top of the receiver housing, whereby the base tilts about the axis defined by the single mounting screw as the at least one set screw is appropriately adjusted.

14. The method as claimed in claim 12 wherein the two facing grooves are generally vertical when the rifle is held horizontally, and wherein the plate is inserted into the space defined by the two grooves by pushing the plate upward from the bottom of the defined space.

15. Apparatus for mounting a scope on a rifle, comprising:

(a) a generally rectangular plate having a configuration which permits it to be inserted into an integral recess along the side of the rifle, and said plate having front and rear edges which have thicknesses which are appropriately sized so as to be inserted into facing grooves which coincide generally with the front and rear boundaries of said integral recess, and there being an engagement length of at least $\frac{1}{2}$ inch in which a front and rear edge mates with a complementary groove, and the plate being configured to abut a rigid portion of the rifle's receiver so that the plate has a limitation on its upward movement, and said plate having a central threaded bore which is accessible from the outer surface of the plate; and (b) structural means for selective attachment to said plate and including a captive screw for engaging the threaded bore on said plate, and further including support means for holding a scope so that it is approximately parallel to the bore of the rifle, and said support means having two small and widely spaced vertical bores which overlie front and rear portions of the rifle's receiver, and said vertical bores being threaded so as to receive set screws to aid in adjusting the elevation of the scope.

* * * * *